US005904290A

United States Patent [19]

Lin

[11] Patent Number: 5,904,290

[45] Date of Patent: May 18, 1999

[54] EASY-TO-OPEN RECYCLABLE ENVELOPE

[76] Inventor: We Ming Lin, No.57, Kon Ming Street, Loton Town, Ilan Hsien, Taiwan

[21] Appl. No.: 08/823,504

[22] Filed: Mar. 25, 1997

[51] Int. Cl.[6] ..... B65D 27/38

[52] U.S. Cl. ..... 229/309; 229/313

[58] Field of Search ..... 229/309, 310, 229/311, 312, 307, 308, 313

[56] References Cited

U.S. PATENT DOCUMENTS

| | | | |
|---|---|---|---|
| 2,956,727 | 10/1960 | Chevan et al. | 229/309 |
| 3,298,598 | 1/1967 | Eberstadt | 229/312 |

FOREIGN PATENT DOCUMENTS

| | | | |
|---|---|---|---|
| 3884 | 9/1926 | Australia | 229/312 |
| 166808 | 4/1934 | Switzerland | 229/309 |
| 343219 | 1/1960 | Switzerland | 229/311 |
| 376760 | 5/1964 | Switzerland | 229/311 |
| 2609 | 9/1905 | United Kingdom | 229/311 |
| 110716 | 11/1917 | United Kingdom | 229/312 |

*Primary Examiner*—Jes F. Pascua
*Attorney, Agent, or Firm*—Bacon & Thomas, PLLC

[57] ABSTRACT

The present invention has a good method of opening envelope and primarily having to provide a better ease of opening method. Its structure is distinctively different from the traditional envelopes or tears open envelopes with characteristics a line of perforation is set on one of the four folding lines of cover flaps. Furthermore, a 2 to 3 mm wide of tenacious tearing wire is adhered to the line of perforation having one end of it consists of an angled tearing line. To open, simply tear from the angled tearing line and lightly pull the tearing wire along the line of perforation towards the opposite end, which allows the tenacious self-adhesive tearing wire to break free from the line of perforation and effectively cutting the envelope open from the line of perforation. It has characteristics that consist of ease of manufacture, ease of use and high reliability of prevent from unintentional opening.

4 Claims, 6 Drawing Sheets

EASY-TO-OPEN RECYCLABLE ENVELOPE

BACKGROUND OF THE INVENTION

1. Field of the Invention

Although technology advancement has made real progress today, from past to present, mailing letters will not likely cease in the near future. The mail system is still the most widely and economical communication method. For a long time, envelopes have not been altered much, except for a small number of styling changes made such as a window, longer or curved cover flap, etc. Regarding envelope opening structure, only additions of a metal clasp or a cotton string closure or a self-adhesive cover flap have been introduced. But with regard to reopening envelope after it has been sealed, no effective improvement or progression has been made obvious.

2. Description of the Prior Art

Recently, some other inventors have come up with envelopes having a cover flap folding line including a cotton string or glue fixture in addition to a cotton string, or a free end of the cotton string, which when pulled, opens the envelope. These inventions include:

A. 1985 Japan Patent numbers 60-27029 & 60-27030

B. 1911 England Patent number 25047

C. 1936 England Patent number 185157

D. 1937 England Patent number 187443

E: 1984 England Patent number 2160172

F. 1986 England Patent number 2190064

G. 1986 England Patent number 2190353

H. 1989 England Patent number 2217682

I. 1930 England Patent number 350700

But obvious shortcomings of these methods are:

1. Gluing and arranging the cotton string along a folding line of a cover flap of an envelope at the same time is difficult to do.
2. Both the process of gluing and arranging the cotton string can not be accomplished by machinery in one step and, therefore, are not economical.
3. It is easy to cause a separation between the cotton string and the cover flap when the cotton string is pulled, thereby disrupting the envelope opening procedure.
4. The free end of the cotton string exposed outside of the envelope may cause mail to be opened by mistake during the delivering process.

Another line of envelope inventions having a cover flap folding line consists of a tear thread exposed at one corner of the envelope, which when pulled toward the opposite end, opens the envelope, for instance:

A. 1948 France Patent number 937010

B. 1975 Swiss Patent number 564919

These designs appear to solve the problem of inadvertent opening of the envelope caused by a separation of the cover flap and cotton string. However, they are difficult to quickly manufacture because every cover flap folding line must be completely sewn with tearing thread. These designs, while useful, are not ideal, and as a result, the present invention was conceived.

The present invention relates to a type envelope which can be easily opened. The main feature of the invention is that it can be applied to either vertical or horizontal layout envelopes. For vertical layout envelopes (Oriental style), lines of perforations are set to overlap the folding lines on the top and bottom cover flaps. For horizontal layout envelopes (Western style), a line of perforations is set to overlap one of the four folding lines of cover flaps. Furthermore, a 2 to 3 mm wide tenacious self-adhesive tearing band is fastened to the line of perforations and intersects with an angled tearing line. To open the user simply tears the angled tearing line and lightly pulls the tearing band along the line of perforations towards the opposite end, thereby allowing the tenacious self-adhesive tearing band to break free from the line of perforations and effectively cut the envelope open along the line of perforations. The present invention has characteristics including ease of manufacture, ease of use and high reliability against preventing unintentional opening.

DETAILED DESCRIPTION OF THE PREFERRED EMBODIMENT

Figure 1:
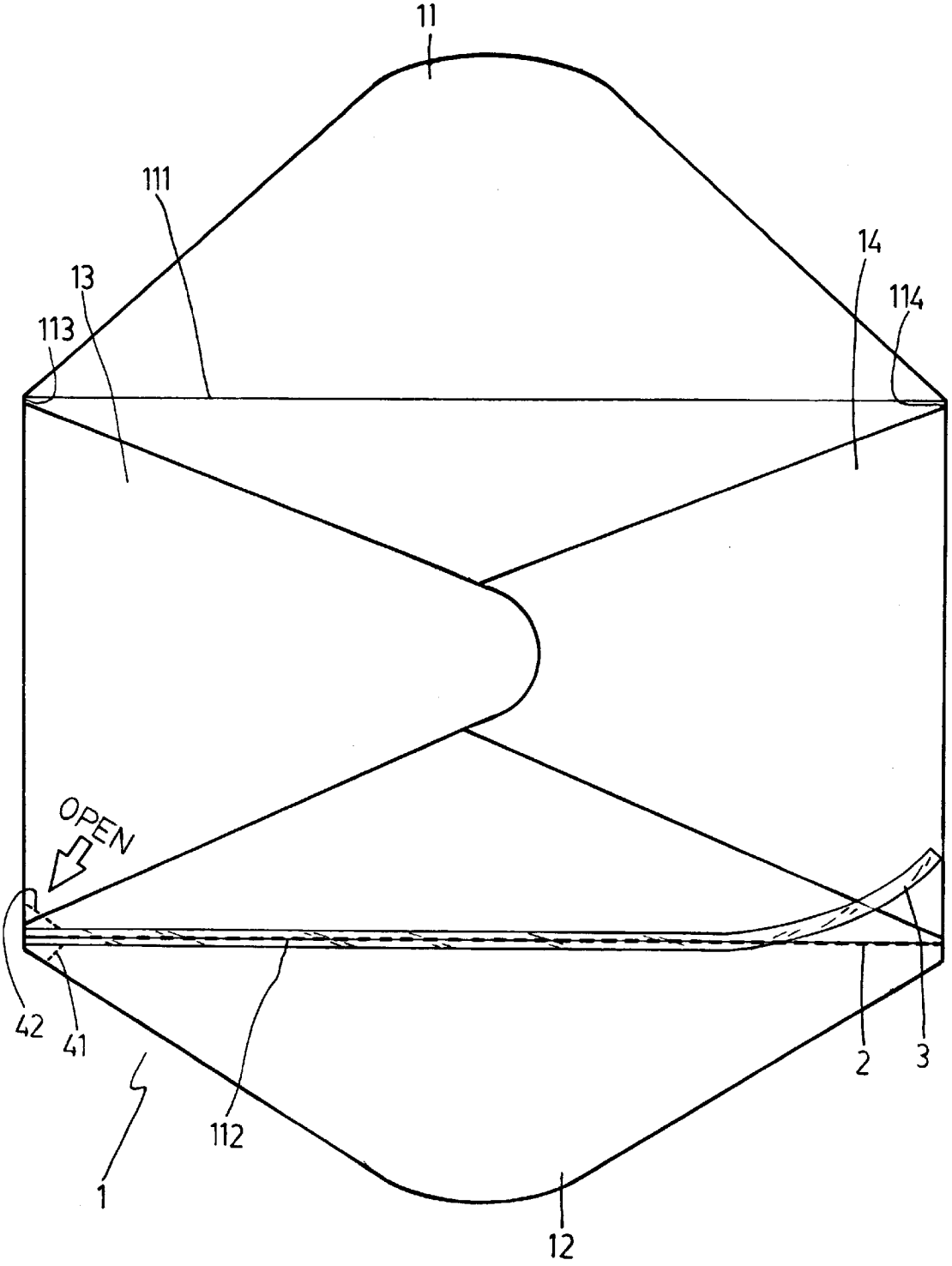
FIG. 1 is an illustration of a horizontal layout envelope with a bottom cover flap including a line of perforations and tenacious self-adhesive band of the present invention.
Figure 2:
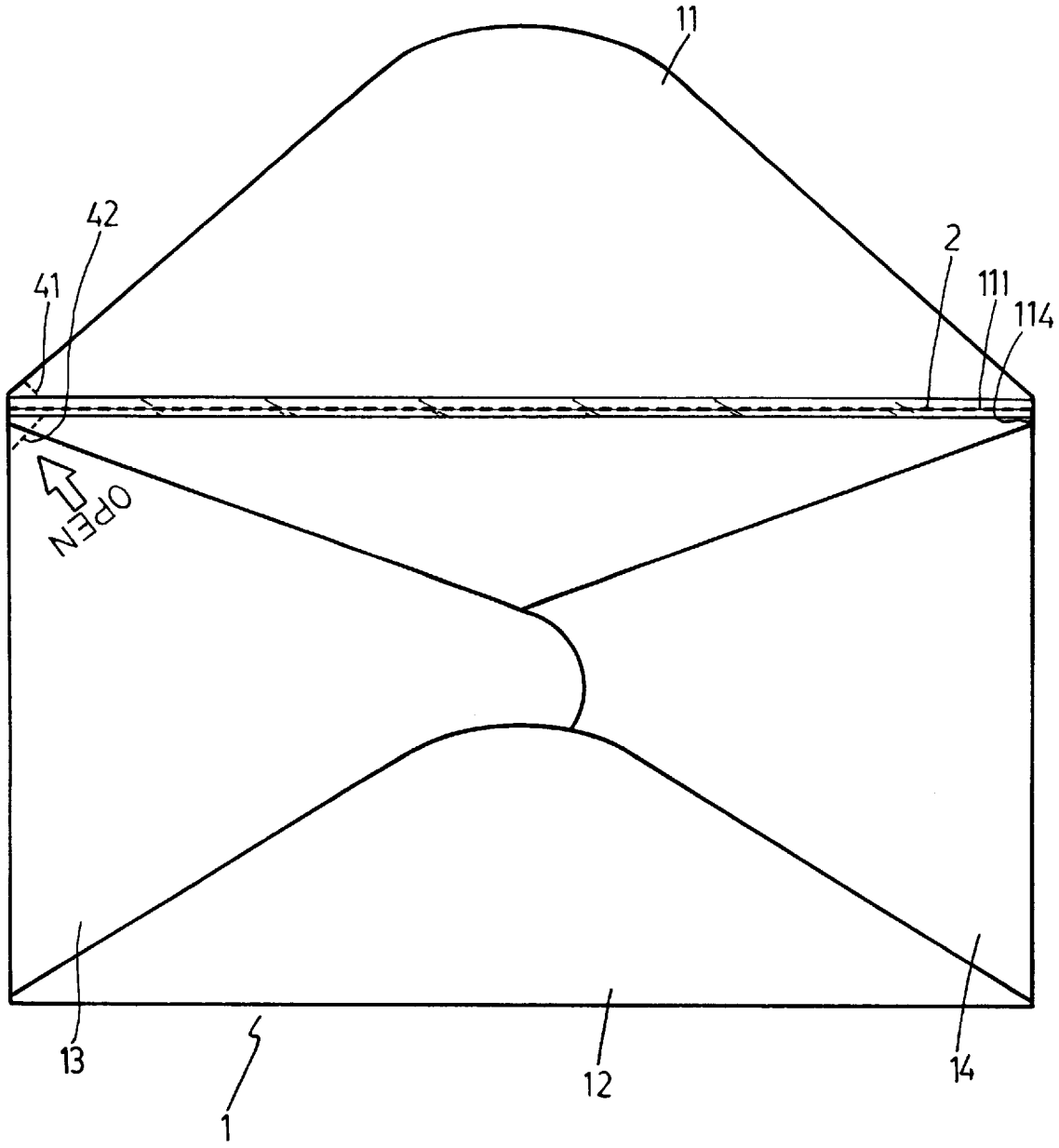
FIG. 2 is an illustration of a line of perforations and a tenacious self-adhesive band disposed directly on the top cover flap of a horizontal layout envelope of the present invention.
Figure 3:
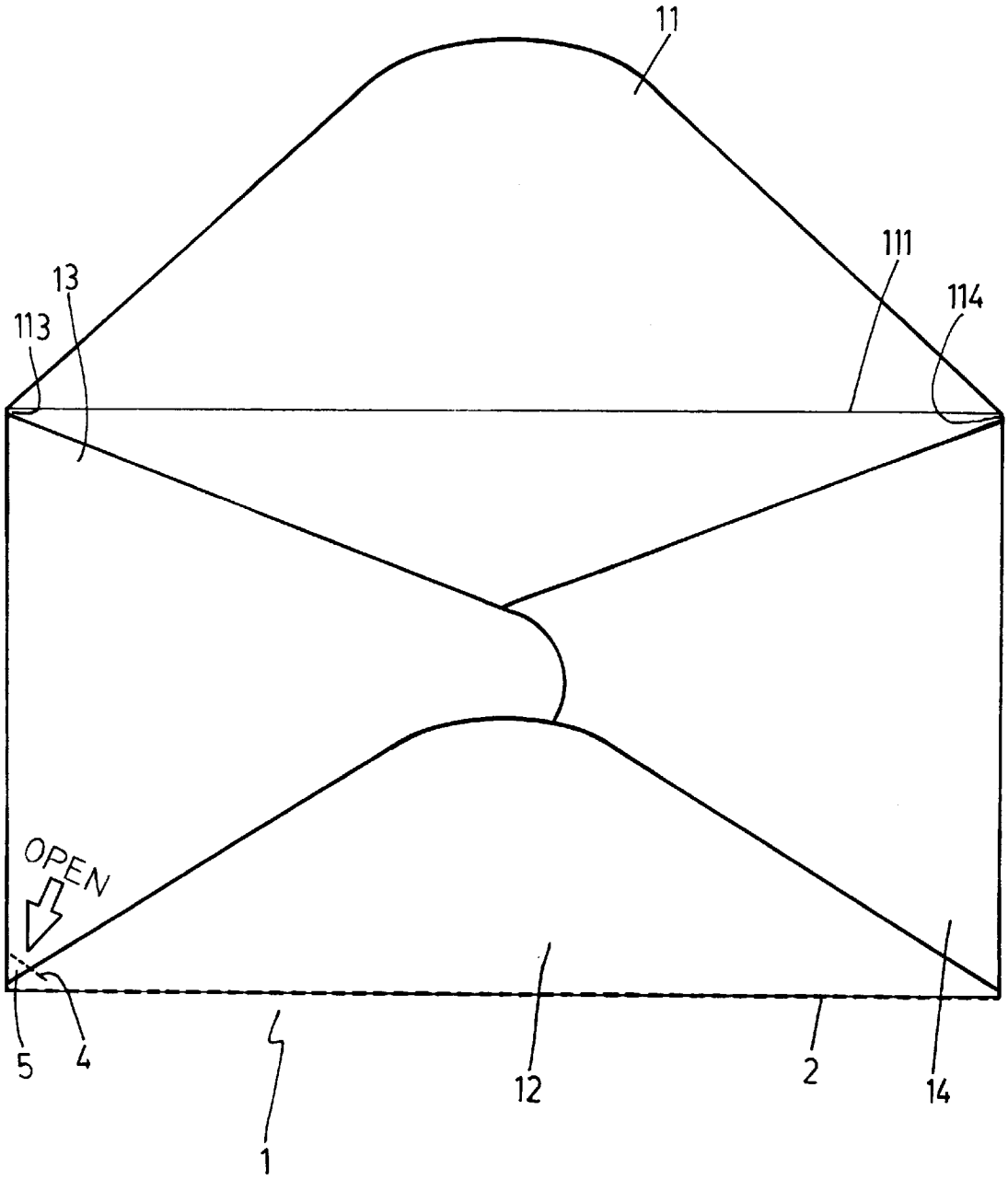
FIG. 3 is a scenario of usage of a horizontal layout envelope with a bottom cover flap including a line of perforations and a tenacious self-adhesive band of the present invention.
Figure 4:
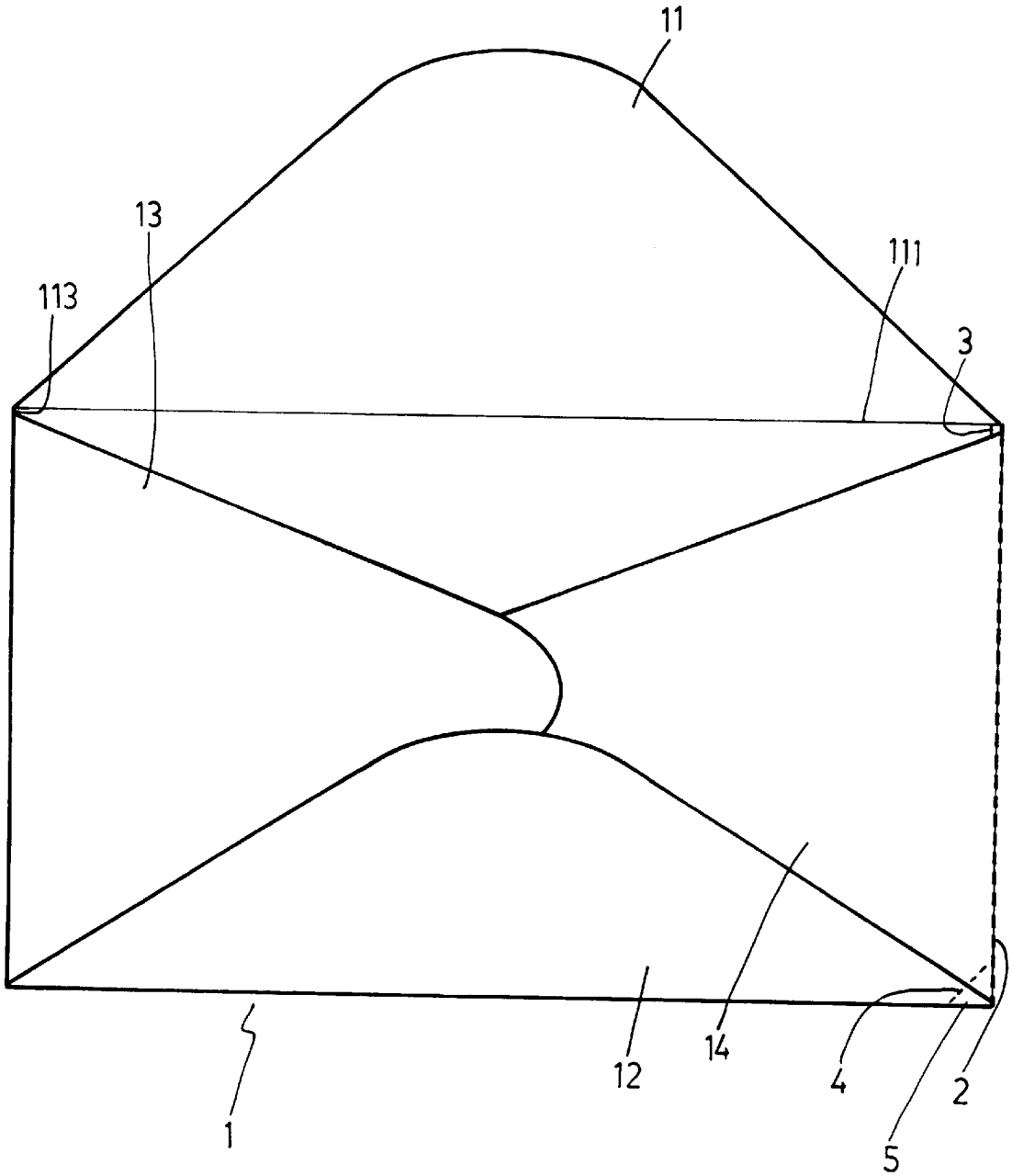
FIG. 4 is a scenario of usage of a horizontal layout envelope with a right cover flap including a line of perforations and a tenacious self-adhesive band of the present invention.

Referring to FIG. 1 through FIG. 5, either a vertical (Oriental style) or horizontal (Western style) envelope (1) has a top cover flap (11), a bottom flap (12), a left cover flap (13) and a right cover flap (14). Between each cover flap and envelope body (1), is a folding line, for example, a top folding line (111), a bottom folding line (112), a left folding line (113) and a right folding line (114). One of the folding lines among the four has a line of perforations (2). Furthermore, a 2 to 3 mm wide tenacious self-adhesive tearing band (3) is adhered coextensively with the line of perforations (2), and one end of which intersects angled tearing lines (41) and (42). Upon folding cover flaps (11), (12), (13) or (14), angled tearing lines (41) and (42) overlap each other to become a tearing line (4) and can be easily torn off, thereby creating a corner piece (5). This causes the adhered tearing band (3) to be folded in half because it is positioned on the inner side of cover flaps (11), (12), (13) or (14), as shown in FIG. 1, 2, 3, 4 and 5.

Figure 5:
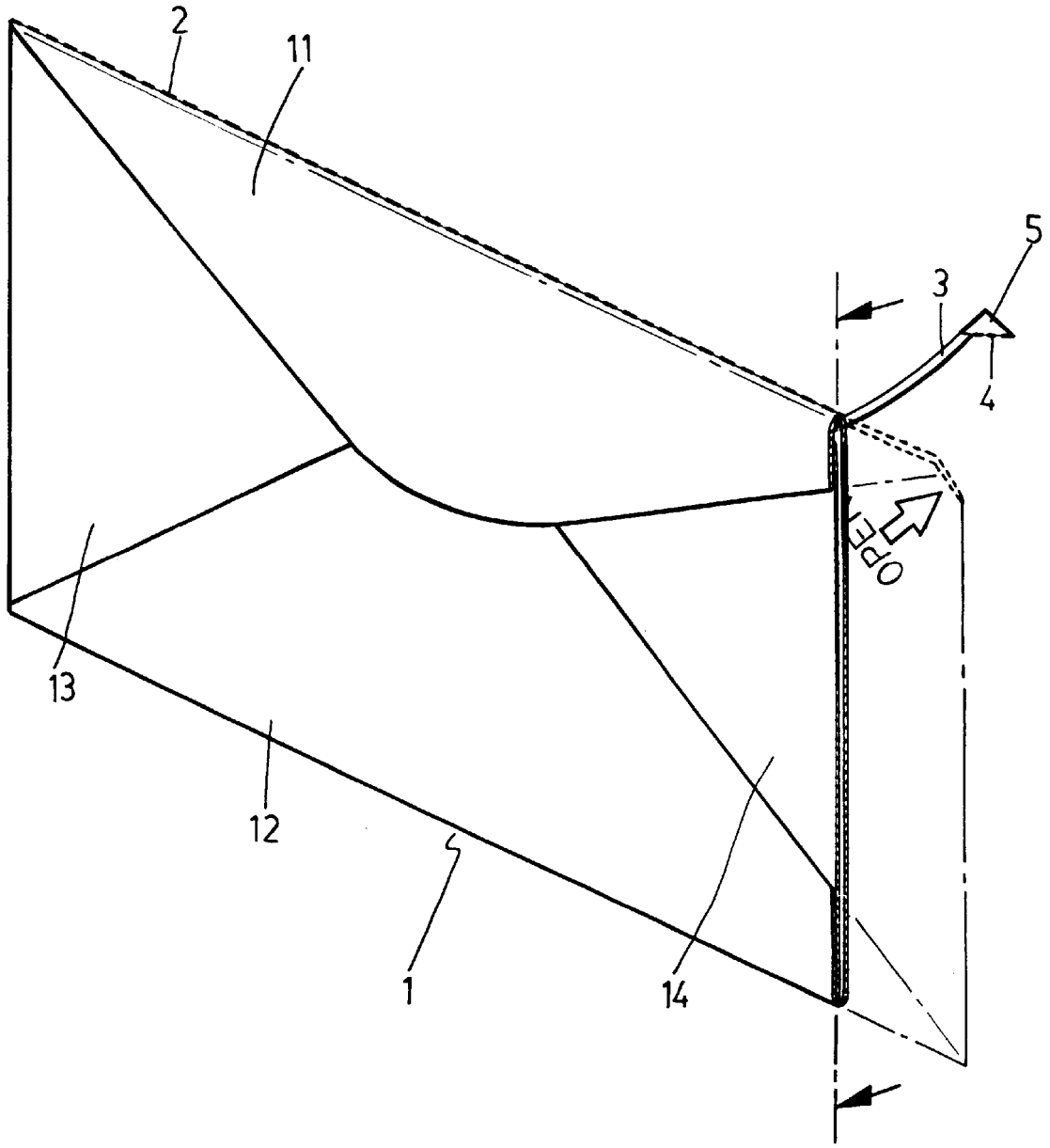
FIG. 5 is a perspective and sectional illustration showing, in use, opening a horizontal layout envelope with a top cover flap including a line of perforations and a tenacious self-adhesive band of the present invention.

To open, simply tear from the angled tearing line (4) to break free the comer piece (5) along with the tearing band (3) and lightly pull towards the opposite end, thereby allowing the tenacious self-adhesive tearing band (3) to break free from the line of perforations (2) and effectively cut the envelope open at the line of perforations (2) on folding lines (111), (112) (113) or (114), because the tearing band (3) is releasably adhered onto folding lines (111), (112), (113) or (114) on the envelope (1), i.e., not permanently adhered to the paper. When pulled, the tenacious self-adhesive tearing band (3) that is adhered to the inner side of line of perforations (2) breaks free from the line of perforations (2) and effectively cuts the line of perforations (2) along folding lines (111), (112), (113), or (114), as shown in FIG. 5. It should be apparent that the present invention offers ease of manufacture, ease of use and high reliability against preventing unintentional opening.

Figure 6:
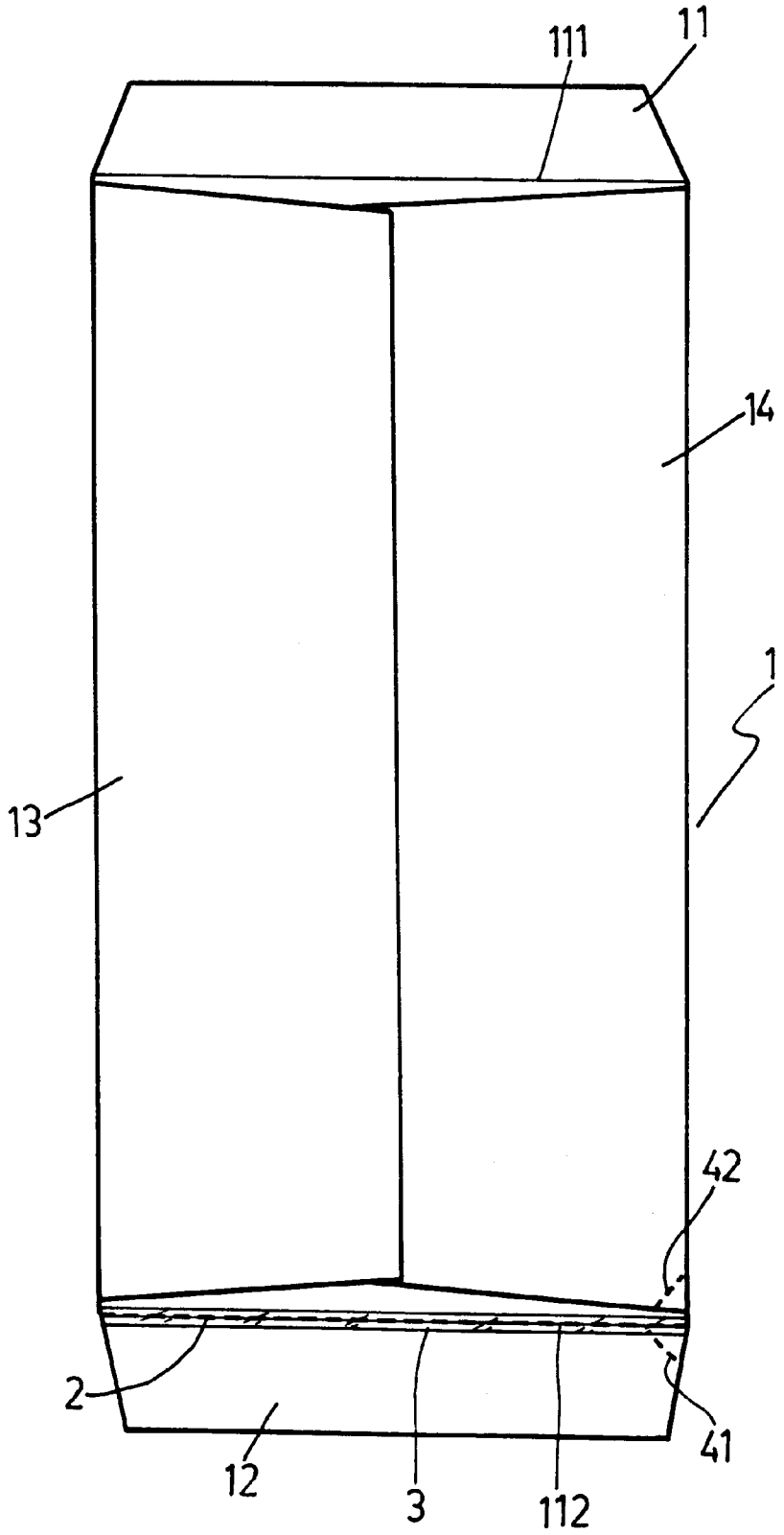
FIG. 6 is a scenario of usage of a vertical layout envelope with a bottom cover flap including a line of perforations and a tenacious self-adhesive band of the present invention.

The line of perforation (2) and the tearing band (3), can be fastened onto any of a top cover flap (11), a bottom flap (12), a left cover flap (13) and a right cover flap (14) for a horizontal layout envelope (1). Either a top cover flap (11) or a bottom cover flap (12) is more suitable for a vertical layout envelope (1), as shown in FIG. 6. But the choice does not affect the design efficiency. As for whether the line of perforations (2) should be located on the top cover flap (11) or the bottom cover flap (12) for either vertical or horizontal layout envelope (1), each has its own benefit. Implementation of the present invention on the top cover flap (11) is compatible with users having the habit of opening envelopes from the top.

Nevertheless, as for users who utilize an electronic stapler to seal envelopes, a small inconvenience can be created when opening the envelope. And if the line of perforations (2) is to be implemented on the bottom cover flap (12), users that employ an electronic stapler to seal envelopes will still be able to open envelopes with ease, as can be seen by comparing FIG. 2, FIG. 3, and FIG. 6.

I claim:

1. An easy-to-open recyclable envelope comprising:

an envelope body having a front and rear envelope wall;

at least one cover flap;

a tenacious self-adhesive tearing band, wherein said self-adhesive tearing band folds in half when the at least one cover flap is folded during use, and said at least one cover flap forms a folding line with the envelope body; and further comprising a line of perforations coextensive with the folding line, wherein said self-adhesive tearing band is coextensive with the folding line and forms a releasable adhesive bond to an inside surface of the folding line, and said front and rear envelope walls each have an angled tearing line, the angled tearing lines being co-aligned and disposed diagonally across at least one envelope corner, the angled tearing lines intersecting the self-adhesive tearing band and forming a corner piece, whereby in use, the self-adhesive tearing band folds in half when the at least one cover flap is folded, and tearing of the tearing lines and lifting of the corner piece causes the self-adhesive tearing band to release completely from the envelope inside surface and lift along the folding line, thereby tearing through the line of perforations and opening the envelope body.

2. The easy-to-open recyclable envelope of claim 1, wherein the self-adhesive tearing band is 2 to 3 mm wide.

3. The easy-to-open recyclable envelope of claim 1, wherein for a vertical layout envelope the at least one cover flap is any of a top cover flap or a bottom cover flap.

4. The easy-to-open recyclable envelope of claim 1, wherein for a horizontal layout envelope the at least one cover flap is any of a top cover flap, a bottom cover flap, a right cover flap or a left cover flap.

* * * * *